US011472451B2

(12) United States Patent
McGavock, Jr.

(10) Patent No.: US 11,472,451 B2
(45) Date of Patent: Oct. 18, 2022

(54) AUTOMATED WARNING TIME INSPECTION AT RAILROAD GRADE CROSSINGS ON A GIVEN TRACK ROUTE

(71) Applicant: Siemens Mobility, Inc., New York, NY (US)

(72) Inventor: Richard Alan McGavock, Jr., Columbia, MO (US)

(73) Assignee: SIEMENS MOBILITY, INC., New York, NY (US)

( * ) Notice: Subject to any disclaimer, the term of this patent is extended or adjusted under 35 U.S.C. 154(b) by 665 days.

(21) Appl. No.: 16/477,465

(22) PCT Filed: Jan. 9, 2018

(86) PCT No.: PCT/US2018/012859

§ 371 (c)(1),
(2) Date: Jul. 11, 2019

(87) PCT Pub. No.: WO2018/132341

PCT Pub. Date: Jul. 19, 2018

(65) Prior Publication Data

US 2019/0382040 A1 Dec. 19, 2019

Related U.S. Application Data

(63) Continuation of application No. 15/404,667, filed on Jan. 12, 2017, now Pat. No. 10,392,037.

(51) Int. Cl.

| | |
|---|---|
| ***B61L 29/32*** | (2006.01) |
| ***B61L 23/00*** | (2006.01) |
| ***B61L 29/30*** | (2006.01) |

(52) U.S. Cl.

CPC ..... *B61L 23/007* (2013.01); *B61L 29/30* (2013.01); *B61L 29/32* (2013.01)

(58) Field of Classification Search

CPC ..... B61L 23/007; B61L 29/30; B61L 29/32
See application file for complete search history.

(56) References Cited

U.S. PATENT DOCUMENTS 8,909,396 B2 * 12/2014 Hilleary ..... B61L 27/00 701/19
9,376,129 B2 * 6/2016 Hilleary ..... B61L 29/30
(Continued)

FOREIGN PATENT DOCUMENTS

GB 2490218 A 10/2012

OTHER PUBLICATIONS

Anon: "Part 234—Grade Crossing Sig- Nal System Safety and State Action Plans", Code of Federal Regulations, Title 49, Subtitle B, chapter II, Dec. 29, 1988 (Dec. 29, 1988), pp. 10-11, XP055463194 /Dec. 29, 1988.

(Continued)

*Primary Examiner* — Zachary L Kuhfuss

(57) ABSTRACT

An automated warning time inspection system (5) and method to test a warning time (45) at a railroad grade crossing (25) on each route for a train (30). The automated warning time inspection system (5) comprises a track circuit (12) configured to activate when a train (30) enters the track circuit (12), an event recorder (17) configured to record a first log time (35(1)) for activation of a crossing warning system (15), a camera (20) to detect a first motion detection indication (40(1)) in a motion detection zone (10) of the camera (20) if there is any motion and an island circuit (22) to detect a presence of the train (30) as the train (30) enters an island (42). The event recorder (17) to record a third log time (35(3)) for switch position indications when present. The event recorder (17) to record a fourth log time (35(4)) for activation of the island circuit (22). The camera (20) to detect a second motion detection indication (40(2)) in the motion detection zone (10) of the camera (20) after the (Continued)

activation of the island circuit (22) if there is any motion. The event recorder (17) to calculate and record a warning time (45) as a difference between the first log time (35(1) and the third log time (35(3)) and based on a motion detection before or after the activation of the island circuit (22) and whether the warning time (45) was more than or equal to a threshold time (50) and whether the train (30) was travelling more than or equal to a threshold speed (52) a passing or a failing of the warning time (45) inspection is logged into the event recorder (17) in a given route (55) of the train (30) travelling on the train track (7).

17 Claims, 13 Drawing Sheets

(56) References Cited

U.S. PATENT DOCUMENTS

| | | | | |
|---|---|---|---|---|
| 9,630,635 | B2 * | 4/2017 | Toshack | B61L 29/282 |
| 10,392,037 | B2 * | 8/2019 | McGavock, Jr. | B61L 29/30 |
| 10,752,273 | B2 * | 8/2020 | Clanney | B61L 29/228 |
| 2006/0261219 | A1 | 11/2006 | Sharkey et al. | |
| 2007/0274158 | A1 * | 11/2007 | Agam | G01P 13/04 367/96 |
| 2008/0103648 | A1 | 5/2008 | Kanner | |
| 2009/0194642 | A1 | 8/2009 | Honeck et al. | |
| 2013/0018534 | A1 | 1/2013 | Hilleary | |
| 2013/0194423 | A1 | 8/2013 | Baines et al. | |
| 2013/0256466 | A1 | 10/2013 | Carlson et al. | |
| 2015/0066255 | A1 * | 3/2015 | Hilleary | B61L 29/30 701/19 |
| 2016/0257322 | A1 * | 9/2016 | Toshack | B61L 13/002 |
| 2016/0362122 | A1 | 12/2016 | Barragan et al. | |
| 2018/0186392 | A1 | 7/2018 | Da et al. | |
| 2018/0194379 | A1 | 7/2018 | Mcgavock | |
| 2018/0222506 | A1 * | 8/2018 | Kranz | B61L 23/04 |
| 2018/0222507 | A1 | 8/2018 | Dejarnatt et al. | |
| 2018/0346003 | A1 | 12/2018 | Wydotis | |
| 2019/0016358 | A1 * | 1/2019 | Clanney | B61L 29/30 |
| 2019/0077429 | A1 | 3/2019 | D'Amico | |
| 2020/0180670 | A1 * | 6/2020 | McGavock, Jr. | B61L 25/02 |

OTHER PUBLICATIONS

PCT International Search Report and Written Opinion of International Searching Authority dated May 4, 2018 corresponding to PCT International Application No. PCT/US2018/012859 filed Jan. 9, 2018.

* cited by examiner

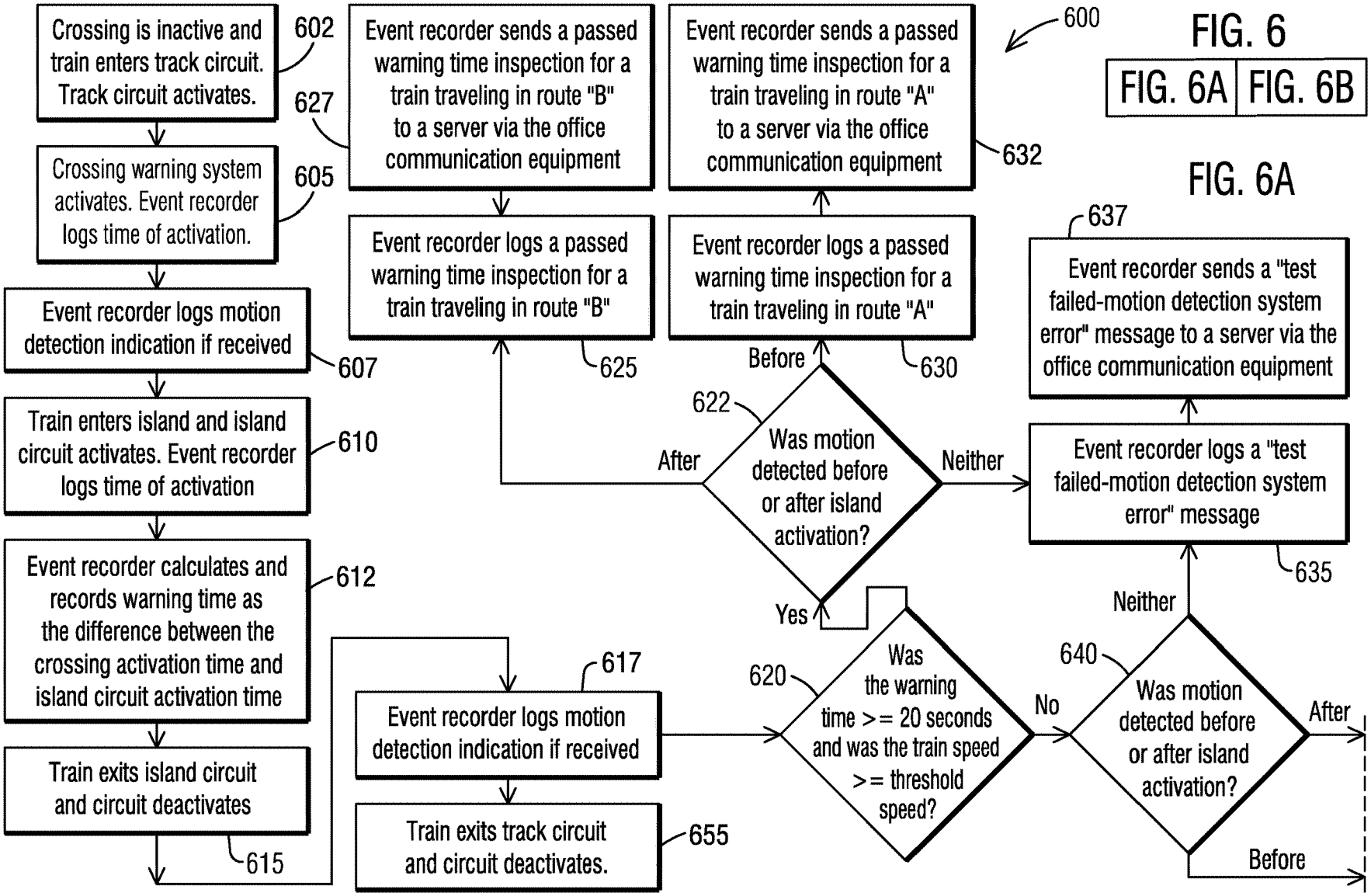
FIG. 6
FIG. 6A
FIG. 6B
FIG. 6A
600
Crossing is inactive and train enters track circuit. Track circuit activates.
602
Crossing warning system activates. Event recorder logs time of activation.
605
Event recorder logs motion detection indication if received
607
Train enters island and island circuit activates. Event recorder logs time of activation
610
Event recorder calculates and records warning time as the difference between the crossing activation time and island circuit activation time
612
Train exits island circuit and circuit deactivates
615
Event recorder logs motion detection indication if received
617
Was the warning time >= 20 seconds and was the train speed >= threshold speed?
620
No
Yes
Was motion detected before or after island activation?
640
After
Before
Neither
Train exits track circuit and circuit deactivates.
655
Was motion detected before or after island activation?
622
After
Before
Neither
Event recorder logs a passed warning time inspection for a train traveling in route "B"
625
Event recorder sends a passed warning time inspection for a train traveling in route "B" to a server via the office communication equipment
627
Event recorder logs a passed warning time inspection for a train traveling in route "A"
630
Event recorder sends a passed warning time inspection for a train traveling in route "A" to a server via the office communication equipment
632
Event recorder logs a "test failed-motion detection system error" message
635
Event recorder sends a "test failed-motion detection system error" message to a server via the office communication equipment
637

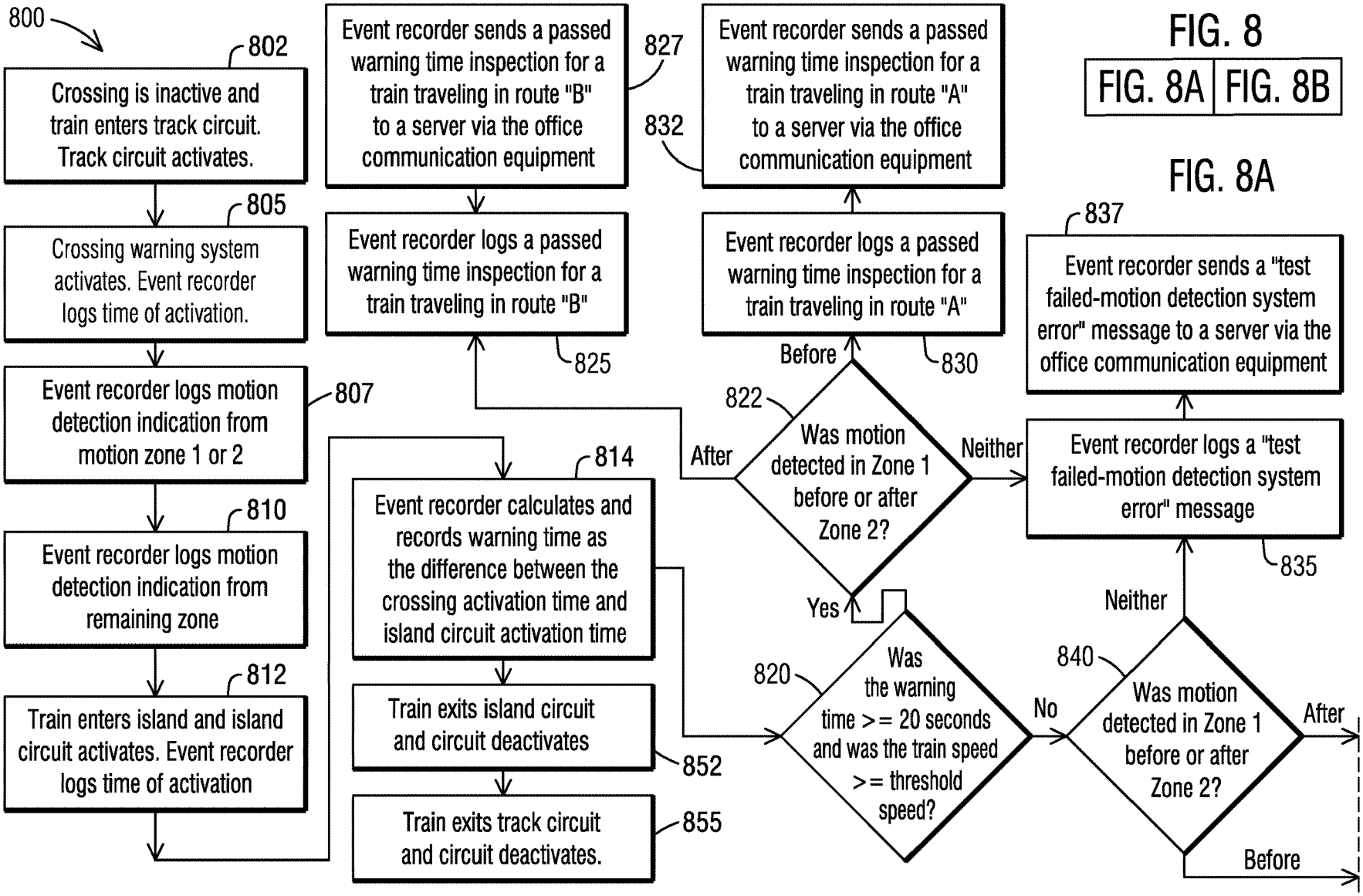
FIG. 8
FIG. 8A
FIG. 8B
FIG. 8A
800
802
Crossing is inactive and train enters track circuit. Track circuit activates.
805
Crossing warning system activates. Event recorder logs time of activation.
807
Event recorder logs motion detection indication from motion zone 1 or 2
810
Event recorder logs motion detection indication from remaining zone
812
Train enters island and island circuit activates. Event recorder logs time of activation
814
Event recorder calculates and records warning time as the difference between the crossing activation time and island circuit activation time
820
Was the warning time >= 20 seconds and was the train speed >= threshold speed?
Yes
No
822
Was motion detected in Zone 1 before or after Zone 2?
Before
After
Neither
825
Event recorder logs a passed warning time inspection for a train traveling in route "B"
827
Event recorder sends a passed warning time inspection for a train traveling in route "B" to a server via the office communication equipment
830
Event recorder logs a passed warning time inspection for a train traveling in route "A"
832
Event recorder sends a passed warning time inspection for a train traveling in route "A" to a server via the office communication equipment
840
Was motion detected in Zone 1 before or after Zone 2?
After
Before
Neither
835
Event recorder logs a "test failed-motion detection system error" message
837
Event recorder sends a "test failed-motion detection system error" message to a server via the office communication equipment
852
Train exits island circuit and circuit deactivates
855
Train exits track circuit and circuit deactivates.

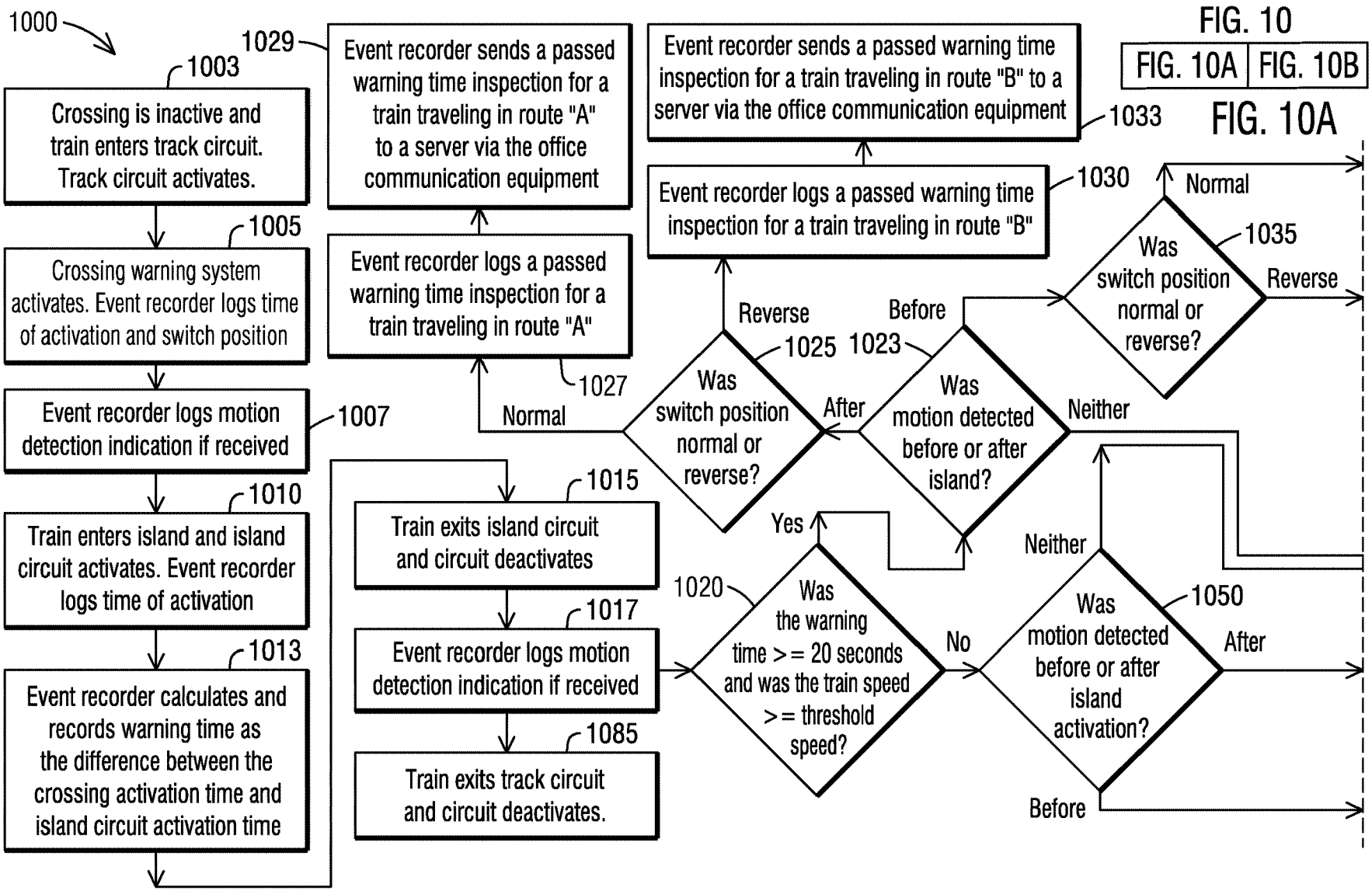
FIG. 10
FIG. 10A
FIG. 10B
FIG. 10A
1000
1003
Crossing is inactive and train enters track circuit. Track circuit activates.
1005
Crossing warning system activates. Event recorder logs time of activation and switch position
1007
Event recorder logs motion detection indication if received
1010
Train enters island and island circuit activates. Event recorder logs time of activation
1013
Event recorder calculates and records warning time as the difference between the crossing activation time and island circuit activation time
1015
Train exits island circuit and circuit deactivates
1017
Event recorder logs motion detection indication if received
1085
Train exits track circuit and circuit deactivates.
1020
Was the warning time >= 20 seconds and was the train speed >= threshold speed?
Yes
No
1023
Was motion detected before or after island?
Before
After
Neither
1025
Was switch position normal or reverse?
Reverse
Normal
1027
Event recorder logs a passed warning time inspection for a train traveling in route "A"
1029
Event recorder sends a passed warning time inspection for a train traveling in route "A" to a server via the office communication equipment
1030
Event recorder logs a passed warning time inspection for a train traveling in route "B"
1033
Event recorder sends a passed warning time inspection for a train traveling in route "B" to a server via the office communication equipment
1035
Was switch position normal or reverse?
Normal
Reverse
1050
Was motion detected before or after island activation?
Neither
After
Before

AUTOMATED WARNING TIME INSPECTION AT RAILROAD GRADE CROSSINGS ON A GIVEN TRACK ROUTE

BACKGROUND

1. Field

Aspects of the present invention generally relate to railroads testing the warning times at railroad grade crossings on each possible route (refers to a track path and a direction) and more specifically relate to an automated warning time inspection system and method.

2. Description of the Related Art

Each year the Federal Railroad Administration (FRA) requires that railroads test the warning times at railroad grade crossings on each possible route per FRA regulation 234.259—Prescribed Warning Time. However, a lot of labor hours are expended by the railroads to complete this testing.

In particular, currently FRA test 234.259 is performed annually by a railroad maintainer. They must wait at each railroad grade crossing on their territory and document the crossing warning times observed on each route (all track paths in both directions). This may require coordination with dispatch so that trains will traverse each approach while the maintainer is onsite. There are currently two other systems under test to accomplish automated testing of FRA 234.259 using inductance. One is wired and the other is wireless. There may also be other systems utilizing radar technology. However, a Prescribed Warning Time test has been one of the more difficult tests to automate due to the lack of devices capable of determining train direction at a reasonable cost.

Therefore, there is a need for a complete automated warning time inspector system that is capable of determining train direction at a reasonable cost and reduces labor costs.

SUMMARY

Briefly described, aspects of the present invention relate to a complete automated warning time inspector system for railroads to test the warning times at railroad grade crossings on each route. An automated warning time inspection system requires a crossing event recorder to collect data and process the automatic inspections to reduce labor costs. The crossing event recorder is designed to run automated inspections may complete test 234.259 automatically with data collected from a Direction Detecting Camera (DDC). This drastically reduces the labor hours expended by the railroads to complete this testing. Pairing camera technology with event recorders has many other uses such as crossing light out detection, crossing gate level detection, the monitoring of movements within train yards, intrusion detection, and more.

In accordance with one illustrative embodiment of the present invention, an automated warning time inspection system is provided. The automated warning time inspection system comprises a track circuit disposed adjacent a railroad crossing to detect presence of a train on a train track such that the track circuit is configured to activate when the train enters the track circuit, a crossing warning system configured to activate when the train activates the track circuit, an event recorder configured to record a first log time for activation of the crossing warning system and a camera to detect a first motion detection indication in a motion detection zone of the camera if there is any motion. The event recorder to record a second log time for the first motion detection indication if received. The automated warning time inspection system further comprises an island circuit to detect a presence of the train as the train enters an island. The event recorder to record a third log time for activation of the island circuit. The camera to detect a second motion detection indication in the motion detection zone of the camera after the activation of the island circuit if there is any motion. The event recorder to record a fourth log time for the second motion detection indication if received. The event recorder to calculate and record a warning time as a difference between the first log time and the third log time and based on a motion detection before or after the activation of the island circuit and whether the warning time was more than or equal to a threshold time and the train travelled more than or equal to a threshold speed a passing or a failing of the warning time inspection is logged into the event recorder for a given route.

In accordance with another illustrative embodiment of the present invention, an automated warning time inspection system is provided. The automated warning time inspection system comprises a track circuit disposed adjacent a railroad crossing to detect presence of a train on a train track such that the track circuit is configured to activate when the train enters the track circuit, a crossing warning system configured to activate when the train activates the track circuit, an event recorder configured to record a first log time for activation of the crossing warning system and a camera to detect a first motion detection indication in a first motion detection zone or a second motion detection zone of the camera. The event recorder to record a second log time for the first motion detection indication. The event recorder to record a third log time for a second motion detection indication from a remaining motion detection zone of the first motion detection zone and the second motion detection zone of the camera that did not indicate first a motion event. The automated warning time inspection system further comprises an island circuit to detect a presence of the train as the train enters an island. The event recorder to record a fourth log time for activation of the island circuit. The event recorder to calculate and record a warning time as a difference between the first log time and the fourth log time and based on a motion detection in the first motion detection zone before or after the second motion detection zone and whether the warning time was more than or equal to a threshold time and the train travelled more than or equal to a threshold speed a passing or a failing of the warning time inspection is logged into the event recorder for a given route.

In accordance with another illustrative embodiment of the present invention, a method for an automated warning time inspection is provided. The method comprises detecting presence of a train on a train track with a track circuit disposed adjacent a railroad crossing such that the track circuit is configured to activate when the train enters the track circuit, activating a crossing warning system when the train activates the track circuit, recording a first log time for activation of the crossing warning system with an event recorder and detecting a first motion detection indication in a motion detection zone of a camera if there is any motion. The event recorder to record a second log time for the first motion detection indication if received. The method further comprises detecting a presence of the train as the train enters an island with an island circuit. The event recorder to record a third log time for activation of the island circuit. The method further comprises detecting a second motion detection indication in the motion detection zone of the camera with the camera after the activation of the island circuit if there is any motion. The event recorder to record a fourth log time for the second motion detection indication if received. The method further comprises calculating and recording a warning time as a difference between the first log time and the third log time with the event recorder and logging a passing or a failing of the warning time inspection into the event recorder in a given direction of the train travelling on the train track based on a motion detection before or after the activation of the island circuit and whether the warning time was more than or equal to a threshold time and the train travelled more than or equal to a threshold speed.

In accordance with yet another illustrative embodiment of the present invention, a method for an automated warning time inspection is provided. The method comprises detecting presence of a train on a train track with a track circuit disposed adjacent a railroad crossing such that the track circuit is configured to activate when the train enters the track circuit, activating a crossing warning system when the train activates the track circuit, recording a first log time for activation of the crossing warning system with an event recorder and detecting a first motion detection indication in a first motion detection zone or a second motion detection zone of a camera. The event recorder to record a second log time for the first motion detection indication. The event recorder to record a third log time for a second motion detection indication from a remaining motion detection zone of the first motion detection zone and the second motion detection zone of the camera that did not indicate first a motion event. The method further comprises detecting a presence of the train as the train enters an island with an island circuit. The event recorder to record a fourth log time for activation of the island circuit. The method further comprises calculating and recording a warning time as a difference between the first log time and the fourth log time with the event recorder and logging a passing or a failing of the warning time inspection into the event recorder in a given direction of the train travelling on the train track based on a motion detection in the first motion detection zone before or after the second motion detection zone and whether the warning time was more than or equal to a threshold time and the train travelled more than or equal to a threshold speed.

DETAILED DESCRIPTION

To facilitate an understanding of embodiments, principles, and features of the present invention, they are explained hereinafter with reference to implementation in illustrative embodiments. In particular, they are described in the context of being an automated warning time inspection system for route detection of a single track or multiple tracks using one or more motion detection zones and/or one or more island circuits and switch position indicators if present. For example, such an automated warning time inspection system may enable railroads to test the warning times at railroad grade crossings on each route (a track path and a direction). Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

An automated warning time inspection system utilizes a motion detecting camera in conjunction with a crossing event recorder to accomplish an automated testing of FRA regulation 234.259—Prescribed Warning Time. The motion detecting camera uses motion detection zones for the purpose of determining train direction (i.e., the direction detection is the primary purpose of the motion detecting camera while route is determined by the event recorder using multiple inputs). Installation is less cumbersome than existing inductance methods currently under test, especially at multi-track locations. A single power over Ethernet wire may be used to both power the motion detecting camera and communicate via Hypertext Transfer Protocol (HTTP) to the crossing event recorder. The motion detecting camera may be mounted in any location where the tracks being tested are constantly in view. Once mounted, multiple motion detection zones are configured within the camera's field of view overlaying the tracks. When motion is detected in a particular motion zone, the motion detecting camera sends a message to the crossing event recorder for processing. The crossing event recorder will then determine a train route based on the motion zone activation messages, track circuit inputs, and switch position inputs (when present). The motion detecting camera allow for up to 10 motion zones in one embodiment. By comparing the sequence of motion zone and island track circuit activation, the crossing event recorder determines the train route on, e.g., up to 10 tracks (future expansion of this technology could allow for more) with a single camera.

Figure 1:
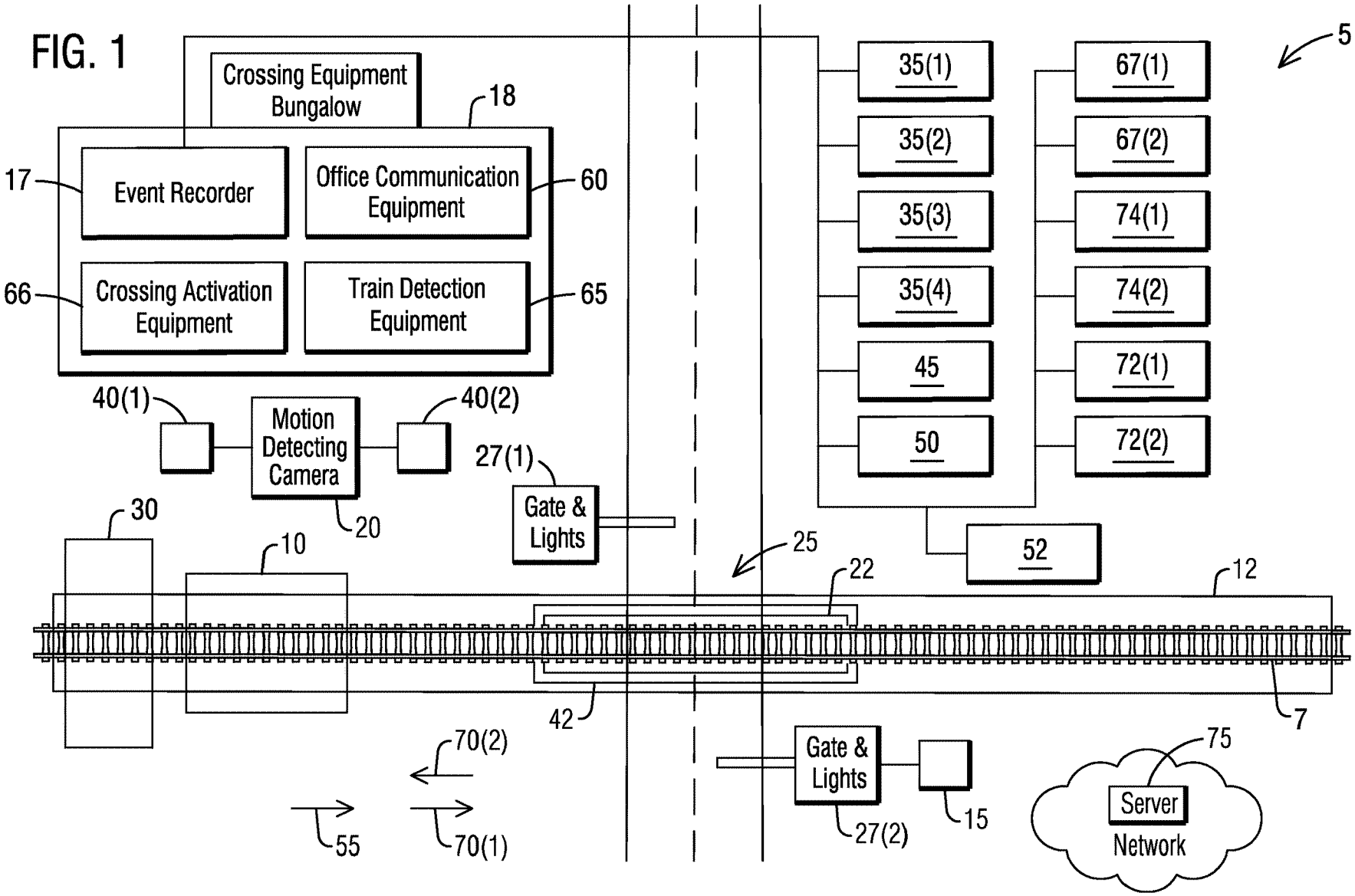
FIG. 1 illustrates a schematic of an automated warning time inspection system for route detection of a single track using one motion detection zone and one island circuit in accordance with an exemplary embodiment of the present invention.

Consistent with one embodiment of the present invention, FIG. 1 represents a schematic of an automated warning time inspection system 5 for direction detection of a single track 7 using a motion detection zone 10 and an island circuit 12 in accordance with an exemplary embodiment of the present invention. The automated warning time inspection system 5 comprises a track circuit 12, a crossing warning system 15, an event recorder 17 at a crossing equipment bungalow 18, a motion detecting camera 20 and an island circuit 22.

In one embodiment, the event recorder 17 may be a crossing event recorder that is a non-vital, commonly stand-alone system designed to provide real-time general purpose status monitoring and event recording for a wide range of functions associated with railroad wayside and grade crossing installations. The event recorder 17 may include multiple digital and analog inputs, relay outputs, LED status lights, a local and external user interface, and a communication link for external sensors. The event recorder 17 may be capable of communicating with a back office system using multiple protocols either directly or with the help of external communication equipment. Application programs may be written to determine if a particular event or sequence of events should generate an informational message or alarm condition. These can then be sent to an office and distributed to maintenance personnel. More advanced applications may be written to handle routine testing required by government agencies such as warning time, backup battery, and ground fault tests.

The track circuit 12 is disposed adjacent a railroad crossing 25 to detect presence of a train 30 on the train track 7. The railroad crossing 25 includes first and second gate and lights 27(1-2). The track circuit 12 is configured to activate when the train 30 enters the track circuit 12. The crossing warning system 15 is configured to activate when the train 30 activates the track circuit 12.

The event recorder 17 is configured to record a first log time 35(1) for activation of the crossing warning system 15. The motion detecting camera 20 to detect a first motion detection indication 40(1) in the motion detection zone 10 of the camera 20 if there is any motion. The event recorder 17 records a second log time 35(2) for the first motion detection indication 40(1) if received.

The island circuit 22 to detect a presence of the train 30 as the train 30 enters an island 42. The event recorder 17 to record a third log time 35(3) for activation of the island circuit 22. The motion detecting camera 20 to detect a second motion detection indication 40(2) in the motion detection zone 10 of the camera 20 after the activation of the island circuit 22 if there is any motion. The event recorder 17 to record a fourth log time 35(4) for the second motion detection indication 40(2) if received.

The event recorder 17 to calculate and record a warning time 45 as a difference between the first log time 35(1) and the third log time 35(3) and based on a motion detection before or after the activation of the island circuit 22 and whether the warning time 45 was more than or equal to a threshold time 50 and the train 30 travelled more than or equal to a threshold speed 52 a passing or a failing of the warning time 45 inspection is logged into the event recorder 17 in a given route 55 of the train 30 travelling on the train track 7.

The warning time 45 is a "Prescribed Warning Time" being the time between a moment the railroad crossing 25 activates and the warning sounds and lights of a gate start sounding and flashing and a moment the train 30 hits the island circuit 22 at the railroad crossing 25. Typically, the "Prescribed Warning Time" is 20 seconds.

The crossing equipment bungalow 18 also houses office communication equipment 60, train detection equipment 65 and crossing activation equipment 66. The event recorder 17 sends automated test data via the office communication equipment 60. The train detection equipment 65 communicates with the track circuit 12 and the island circuit 22. The crossing activation equipment 66 communicates with the crossing warning system 15 to operate the first and second gate and lights 27(1-2).

As soon as the train 30 steps on the track circuit 12 or the island circuit 22, the event recorder time stamps that event and logs a time stamp of that event. When the train 30 hits the island circuit 22 the island circuit 22 sends a voltage signal to the event recorder 17. The event recorder 17 understands that the island circuit 22 has dropped. When the train 30 passes the motion detecting camera 20, a motion detection zone is dropped as the camera 20 captures the motion of the train 30. The motion detecting camera 20 sends an HTTP message to the event recorder 17. The event recorder 17 sends this automated test data to a server 75 via the office communication equipment 60. The server 75 may be an office server that stores automated test data. The event recorder 17 stores data locally and transmits it to a central server such as the server 75 using a wireless and/or a wired connection.

The event recorder 17 determines whether the warning time 45 was more than or equal to the threshold time 50 and the train 30 travelled more than or equal to the threshold speed 52 and then the event recorder 17 checks whether a motion event is detected before or after the activation of the island circuit 22. If the warning time 45 was not more than or equal to the threshold time 50 or the train 30 travelled less than the threshold speed 52 and the event recorder 17 records the motion event before the activation of the island circuit 22 then the event recorder 17 logs a failed warning time inspection indication 67(1) for the train 30 travelling in a first route 70(1). The event recorder 17 sends the failed warning time inspection indication 67(1) for the train 30 travelling in the first route 70(1) to the server 75 via the office communication equipment 60.

If the warning time 45 was not more than or equal to the threshold time 50 or the train 30 travelled less than the threshold speed 52 and the event recorder 17 records the motion event after the activation of the island circuit 22 then the event recorder 17 logs a failed warning time inspection indication 67(2) for the train 30 travelling in a second route 70(2) different than the first route 70(1). The event recorder 17 sends the failed warning time inspection indication 67(2) for the train 30 travelling in the second route 70(2) to the server 75 via the office communication equipment 60. If the warning time 45 was not more than or equal to the threshold time 50 or the train travelled less than the threshold speed 52 and the event recorder 17 records the motion event neither before nor after the activation of the island circuit 22 then the event recorder 17 logs a test failed-motion detection system error message 72(1). The event recorder 17 sends the test failed-motion detection system error message 72(1) to the server 75 via the office communication equipment 60.

If the warning time 45 was more than or equal to the threshold time 50 and the train travelled more than or equal to the threshold speed 52 and the event recorder 17 records the motion event before the activation of the island circuit 22 then the event recorder 17 logs a passed warning time inspection indication 74(1) for the train 30 travelling in the first route 70(1). The event recorder 17 sends the passed warning time inspection indication 74(1) for the train 30 travelling in the first route 70(1) to the server 75 via the office communication equipment 60.

If the warning time 45 was more than or equal to the threshold time 50 and the train travelled more than or equal to the threshold speed 52 and the event recorder 17 records the motion event after the activation of the island circuit 22 then the event recorder 17 logs a passed warning time inspection indication 74(2) for the train 30 travelling in the second route 70(2) different than the first route 70(1). The event recorder 17 sends the passed warning time inspection indication 74(2) for the train 30 travelling in the second route 70(2) to the server 75 via the office communication equipment 60. If the warning time 45 was more than or equal to the threshold time 50 and the train travelled more than or equal to the threshold speed 52 and the event recorder 17 records the motion event neither before nor after the activation of the island circuit 22 then the event recorder 17 logs a test failed-motion detection system error message 72(2).

The event recorder 17 may capture one train on each track in every route at least once a year. This will save time and labor of the track maintainer because they don't have to do these mandatory tests manually. The event recorder 17 may record the speed of the train on the train track 7. The event recorder 17 may record the flashing of lights if a gate is going up or down. The event recorder 17 puts a time stamp on all events logged into it. The event recorder 17 may record switch positions.

By having the island circuit drop the event recorder 17 can determine the direction of the train 30 or having a second motion detection zone activating the event recorder 17 can determine the direction of the train. A train direction may be detected by the event recorder 17 by logging a sequence of activation on a single track of one motion detection zone and one island circuit. A train direction may be detected by the event recorder 17 by logging a sequence of activation on a single track of two motion detection zones.

Figure 2:
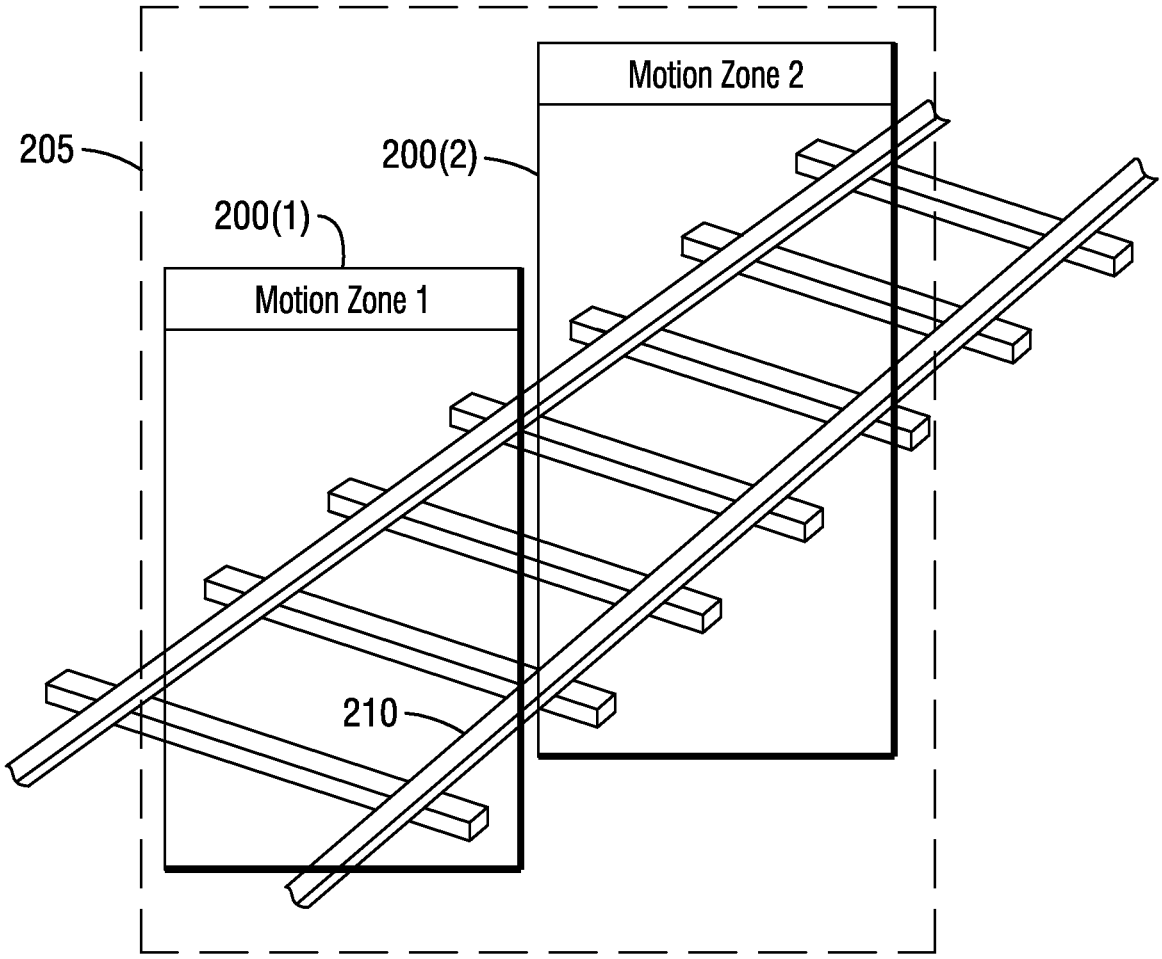
FIG. 2 illustrates a schematic of motion zone positions within a motion detecting camera's field of view overlaying one or more tracks in accordance with an exemplary embodiment of the present invention.

Referring to FIG. 2, it illustrates a schematic of positions of first and second motion detection zones 200(1-2) within a field of view 205 of the motion detecting camera 20 overlaying a railway track 210 in accordance with an exemplary embodiment of the present invention.

Figure 3:
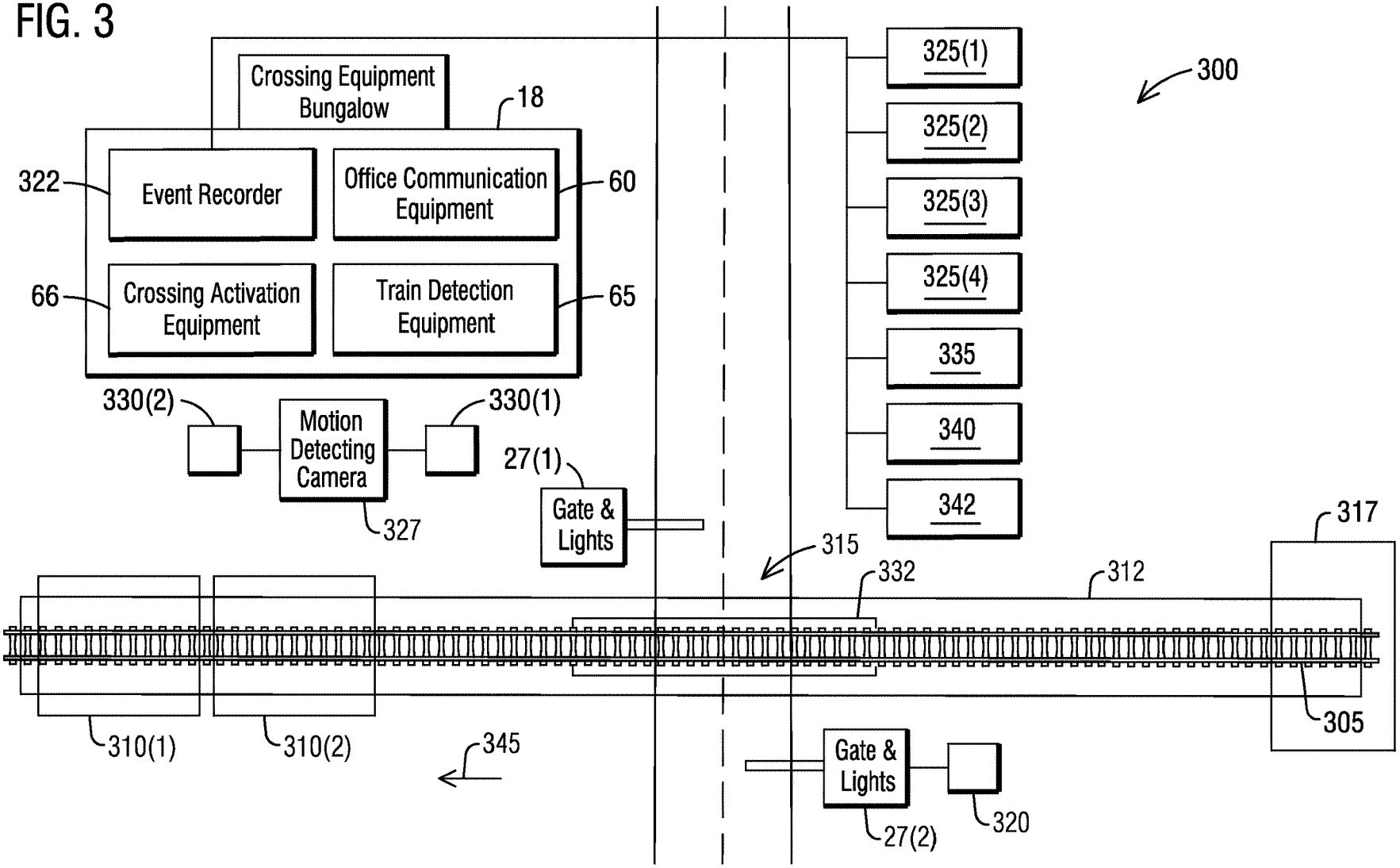
FIG. 3 illustrates a schematic block diagram of an automated warning time inspection system for route detection of a single track using two motion zones and not using an island circuit in accordance with an exemplary embodiment of the present invention.

Turning now to FIG. 3, it illustrates a schematic block diagram of an automated warning time inspection system 300 for direction detection of a train track 305 using first and second motion detection zones 310(1-2) and not using an island circuit in accordance with an exemplary embodiment of the present invention. The automated warning time inspection system 300 comprises a track circuit 312 disposed adjacent a railroad crossing 315 to detect presence of a train 317 on the train track 305. The track circuit 312 is configured to activate when the train 317 enters the track circuit 312.

The automated warning time inspection system 300 further comprises a crossing warning system 70 configured to activate when the train 317 activates the track circuit 312. The automated warning time inspection system 300 further comprises an event recorder 72 configured to record a first log time 75(1) for activation of the crossing warning system 70.

The automated warning time inspection system 300 further comprises a motion detecting camera 327 to detect a first motion detection indication 330(1) in the first motion detection zone 310(1) or the second motion detection zone 310(2) of the camera 327. The event recorder 322 to record a second log time 325(2) for the first motion detection indication 330(1). The event recorder 322 to record a third log time 325(3) for a second motion detection indication 330(2) from a remaining motion detection zone of the first motion detection zone 310(1) and the second motion detection zone 310(2) of the camera 327 that did not indicate first a motion event.

The automated warning time inspection system 300 further comprises an island circuit 332 to detect a presence of the train 317 as the train 317 enters an island. The event recorder 322 to record a fourth log time 325(4) for activation of the island circuit 332.

The event recorder 322 calculates and records a warning time 335 as a difference between the first log time 325(1) and the fourth log time 325(4) and based on a motion detection in the first motion detection zone 310(1) before or after the second motion detection zone 310(2) and whether the warning time 335 was more than or equal to a threshold time 340 and whether the train travelled more than or equal to a threshold speed 342 a passing or a failing of the warning time 335 inspection is logged into the event recorder 322 in a given route 345 of the train 317 travelling on the train track 305. The event recorder 322 to determine whether the warning time 335 was more than or equal to the threshold time 340 and whether the train travelled more than or equal to the threshold speed 342 and then the event recorder 322 checks whether a motion event is detected in the first motion detection zone 310(1) before or after the second motion detection zone 310(2).

The first motion detection zone 310(1) and the second motion detection zone 310(2) are setup to determine the train direction 345. Depending upon which direction the train 317 is moving either the first motion detection zone 310(1) or the second motion detection zone 310(2) gets activated first such that once both the first motion detection zone 310(1) or the second motion detection zone 310(2) gets activated the train direction 345 is determined.

Figure 4:
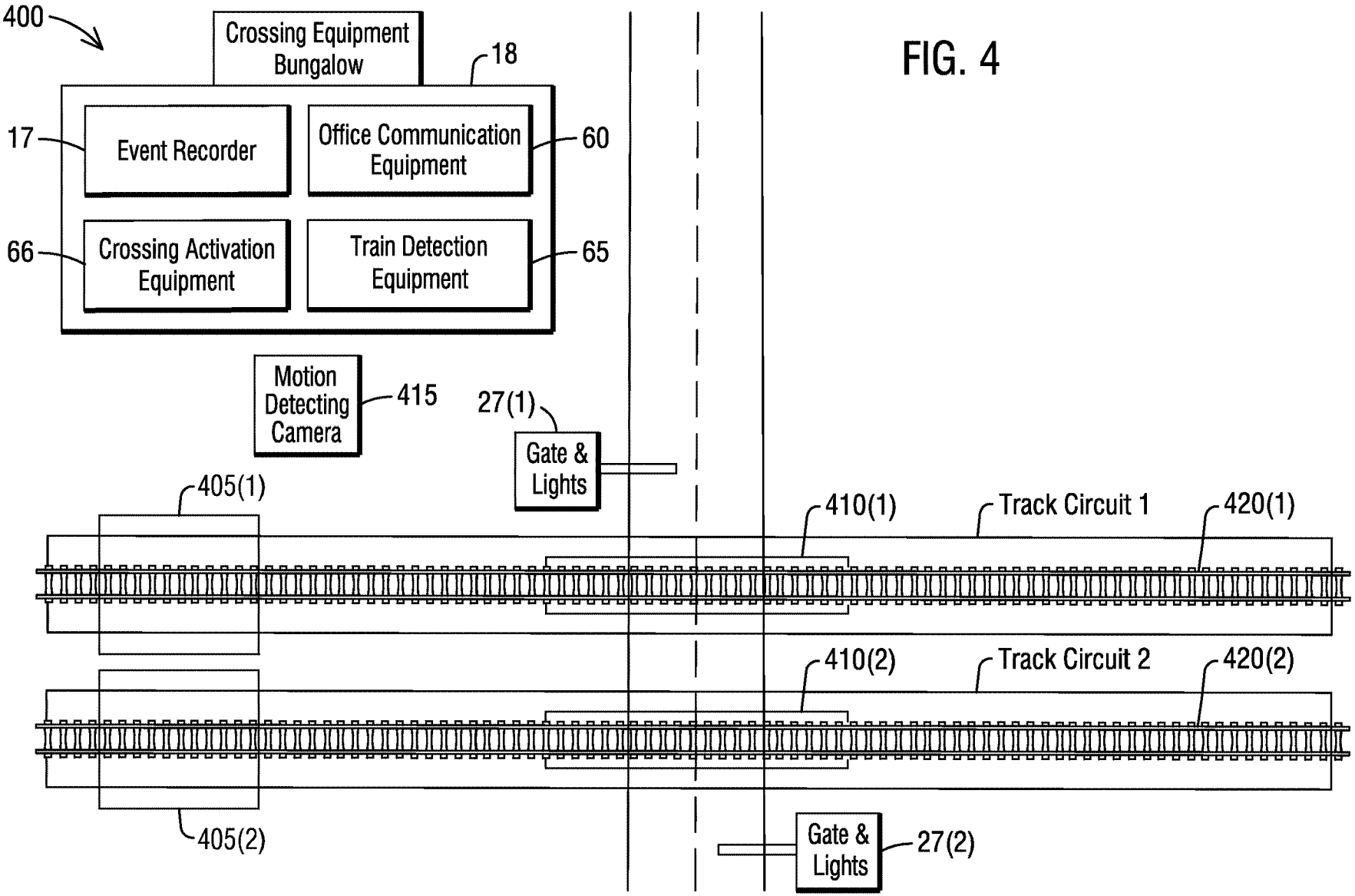
FIG. 4 illustrates a schematic block diagram of an automated warning time inspection system for dual track direction detection using two motion zones and two island circuits in accordance with another exemplary embodiment of the present invention.

FIG. 4 illustrates a schematic block diagram of an automated warning time inspection system 400 for dual track direction detection using first and second motion detection zones 405(1-2) and first and second island circuits 410(1-2) in accordance with another exemplary embodiment of the present invention. The positions of first and second motion detection zones 405(1-2) lie within a field of view of a motion detecting camera 415 overlaying first and second railway tracks 420(1-2) in accordance with an exemplary embodiment of the present invention.

Figure 5:
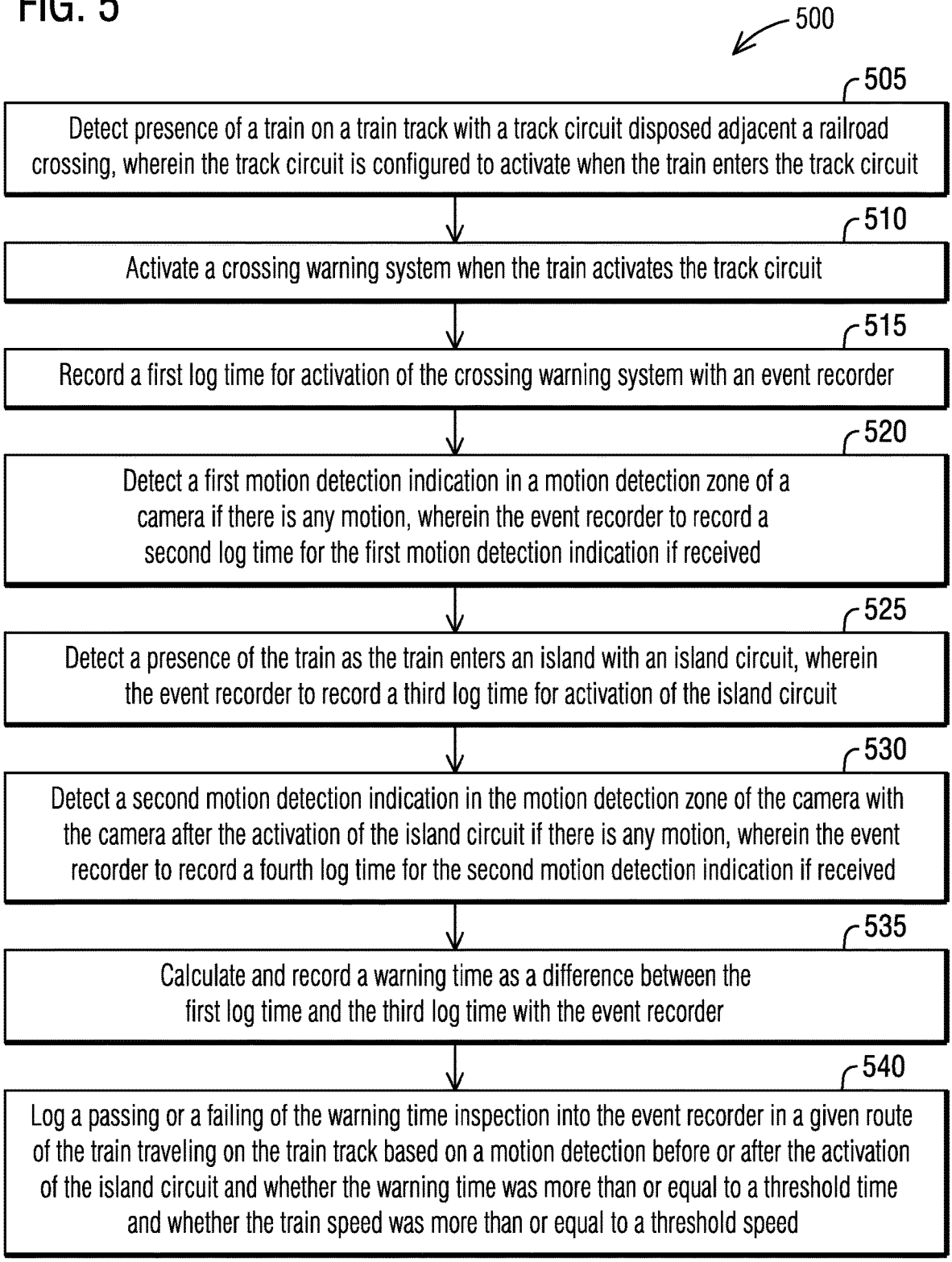
FIG. 5 illustrates a flow chart of a method of automated warning time inspection for route detection of a single track using one motion detection zone and one island circuit according to an exemplary embodiment of the present invention.

As seen in FIG. 5, it illustrates a flow chart of a method 500 of automated warning time inspection for direction detection of a single track using one motion detection zone and one island circuit according to an exemplary embodiment of the present invention. Reference is made to the elements and features described in FIGS. 1-4. It should be appreciated that some steps are not required to be performed in any particular order, and that some steps are optional.

The method 500 for an automated warning time inspection in step 505 includes detecting presence of a train on a train track with a track circuit disposed adjacent a railroad crossing. The track circuit is configured to activate when the train enters the track circuit. In step 510, the method 500 activates a crossing warning system when the train activates the track circuit. Recording of a first log time for activation of the crossing warning system takes place with an event recorder at step 515.

The method 500 in step 520 includes detecting a first motion detection indication in a motion detection zone of a camera if there is any motion. The event recorder to record a second log time for the first motion detection indication if received. The method 500 in step 525 further includes detecting a presence of the train as the train enters an island with an island circuit. The event recorder records a third log time for activation of the island circuit.

In step 530, the method 500 detects a second motion detection indication in the motion detection zone of the camera with the camera after the activation of the island circuit if there is any motion. The event recorder to record a fourth log time for the second motion detection indication if received. At step 535, the event recorder calculates and records a warning time as a difference between the first log time and the third log time.

The method 500 in step 540 finally includes logging a passing or a failing of the warning time inspection into the event recorder in a given route of the train travelling on the train track based on a motion detection before or after the activation of the island circuit and whether the warning time was more than or equal to a threshold time and whether the train travelled more than or equal to a threshold speed. The method 500 further includes determining with the event recorder whether the warning time was more than or equal to the threshold time and whether the train travelled more than or equal to the threshold speed and checking with the event recorder whether a motion event is detected before or after the activation of the island circuit.

Figure 6B:
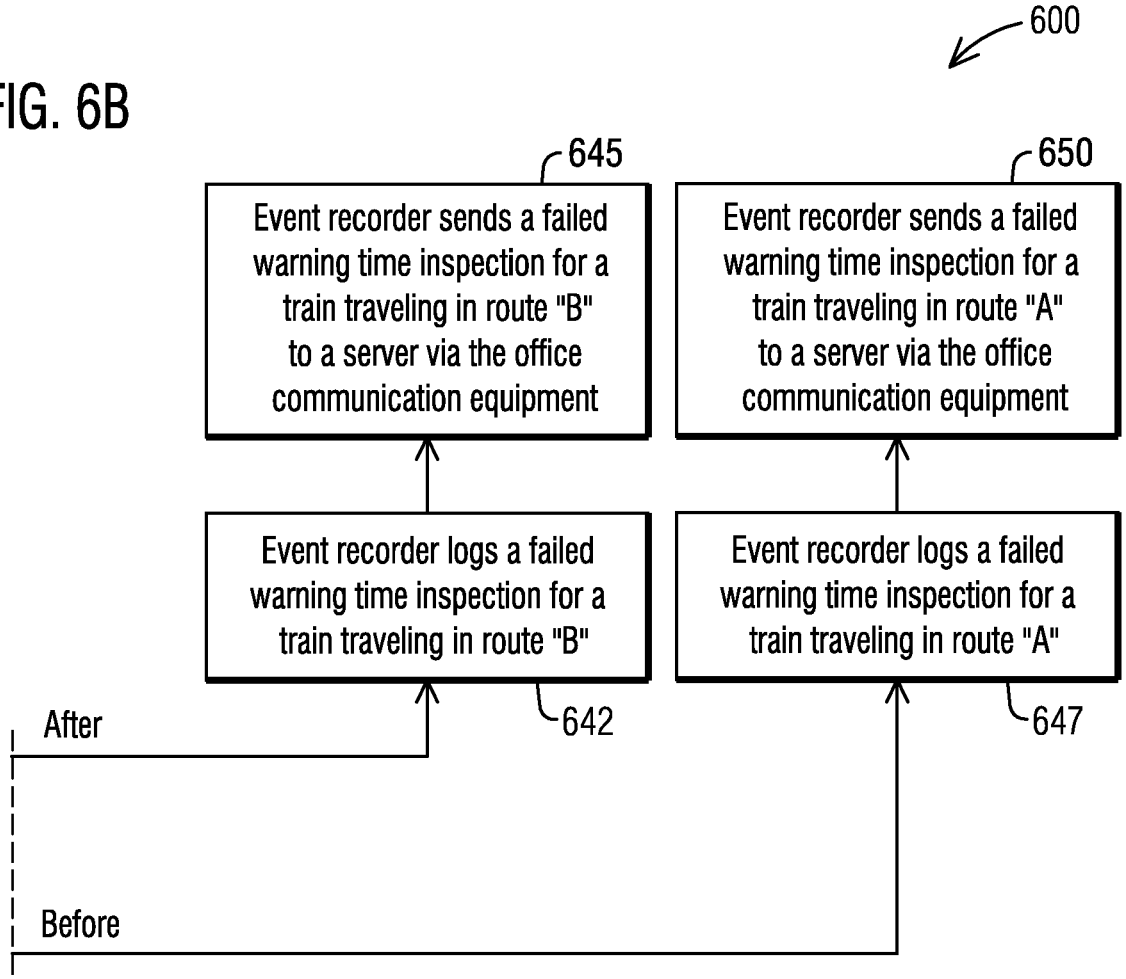
FIG. 6 illustrates a flow chart of a detailed method of automated warning time inspection for route detection of a single track using one motion detection zone and one island circuit according to an exemplary embodiment of the present invention.

As shown in FIG. 6, it illustrates a flow chart of a detailed method 600 of automated warning time inspection for direction detection of a single track using one motion detection zone and one island circuit according to an exemplary embodiment of the present invention. Reference is made to the elements and features described in FIGS. 1-4. It should be appreciated that some steps are not required to be performed in any particular order, and that some steps are optional.

At step 602, the railroad crossing 25 is inactive and the train 30 enters the track circuit 12. The track circuit 12 activates. At step 605, the crossing warning system 15 activates. The event recorder 17 logs a time of activation of the crossing warning system 15. At step 607, the event recorder 17 logs a motion detection indication if received. At step 610, the train 30 enters an island and the island circuit 22 activates. The event recorder 17 logs a time of activation of the island circuit 22. At step 612, the event recorder 17 calculates and records a warning time as the difference between the crossing activation time and island circuit activation time. At step 615, the train 30 exits the island circuit 22 and the island circuit 22 deactivates. At step 617, the event recorder 17 logs a motion detection indication if received.

At a decision block 620, a check is made as to the warning time being greater than or equal to a threshold time such as 20 seconds and whether the train 30 travelled more than or equal to a threshold speed such as 50 mph. If YES, at a decision box 622, another check is made as to whether motion was detected before or after the island circuit 22 activation. If AFTER, at step 625, the event recorder 17 logs a passed warning time inspection for the train 30 traveling in a route "B". At step 627, the event recorder 17 sends a passed warning time inspection for the train 30 traveling in the route "B" to the server 75 via the office communication equipment 60. If BEFORE, at step 630, the event recorder 17 logs a passed warning time inspection for the train traveling in a route "A". At step 67, the event recorder 17 sends a passed warning time inspection for the train 30 traveling in the route "A" to the server 75 via the office communication equipment 60. If NEITHER, at step 635, the event recorder 17 logs a "test failed—motion detection system error" message. At step 637, the event recorder 17 sends a "test failed—motion detection system error" message to the server 75 via the office communication equipment 60.

If at the decision block 620, it is NO, at a decision box 640, another check is made as to whether motion was detected before or after the island circuit 22 activation. If NEITHER, the method 600 goes to the step 635 as set forth above. If AFTER, at step 642, the event recorder 17 logs a failed warning time inspection for the train 30 traveling in the route "B". At step 645, the event recorder 17 sends a failed warning time inspection for the train 30 traveling in the route "B" to the server 75 via the office communication equipment 60. If BEFORE, at step 647, the event recorder 17 logs a failed warning time inspection for the train traveling in the route "A". At step 650, the event recorder 17 sends a failed warning time inspection for the train 30 traveling in the route "A" to the server 75 via the office communication equipment 60. At step 655, the train 30 exits the track circuit 12 and the track circuit 12 deactivates.

In one embodiment, the event recorder 17 will only log motion events while the track circuit 12 is active. Additionally, the event recorder 17 will only utilize the first motion indication from each zone, any duplicates will be ignored.

Figure 7:
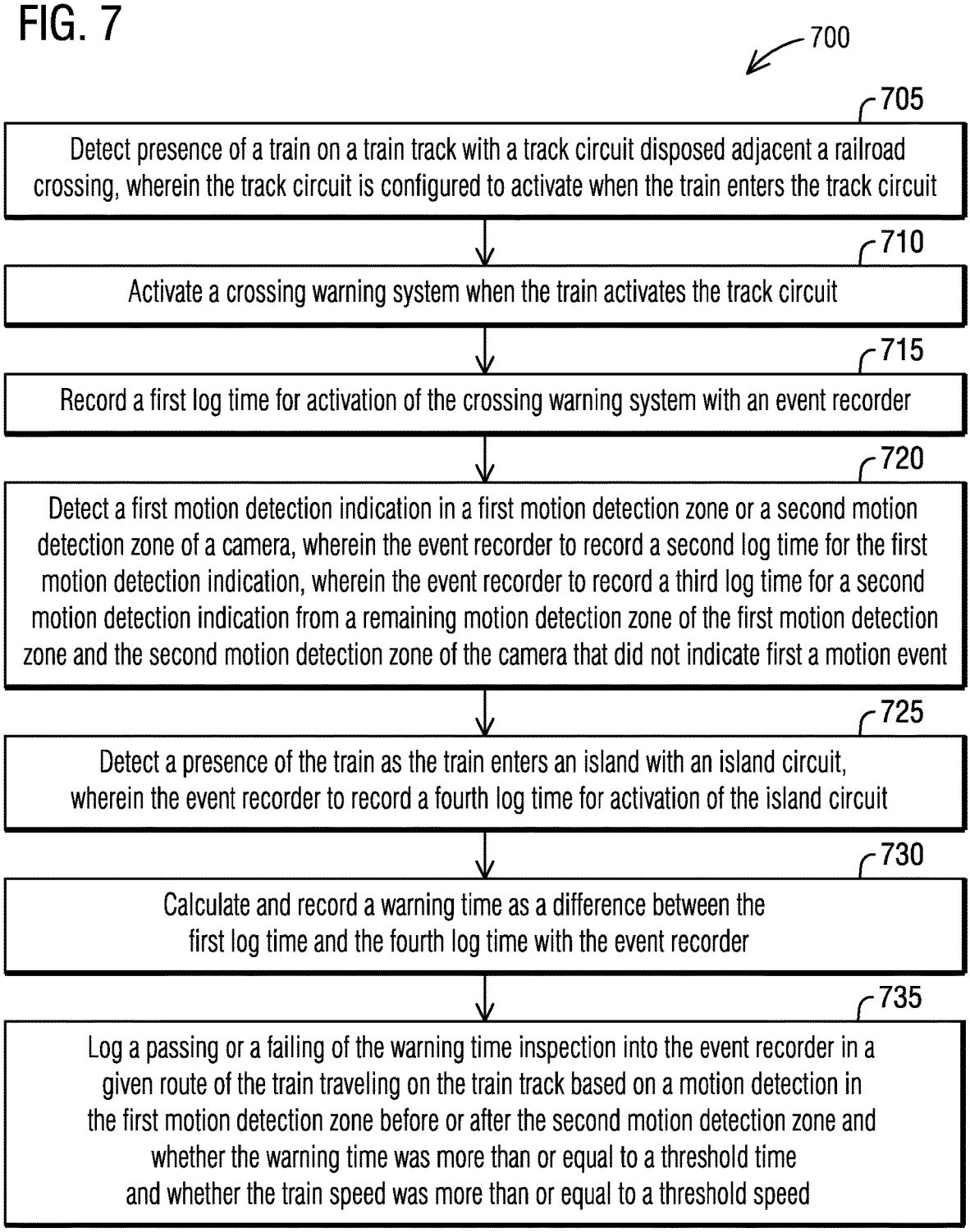
FIG. 7 illustrates a flow chart of a method of automated warning time inspection for route detection of a single track using two motion zones according to an exemplary embodiment of the present invention.

In FIG. 7, a flow chart of a method 700 of automated warning time inspection for direction detection of a single track using two motion zones is illustrated according to an exemplary embodiment of the present invention. Reference is made to the elements and features described in FIGS. 1-4. It should be appreciated that some steps are not required to be performed in any particular order, and that some steps are optional.

The method 700 for an automated warning time inspection comprises detecting presence of a train on a train track with a track circuit disposed adjacent a railroad crossing at step 705. The track circuit is configured to activate when the train enters the track circuit. The method 700 in step 710 further includes activating a crossing warning system when the train activates the track circuit;

In step 715, an event recorder records a first log time for activation of the crossing warning system. At step 720, the automated warning time inspection system detects a first motion detection indication in a first motion detection zone or a second motion detection zone of a camera. The event recorder records a second log time for the first motion detection indication. The event recorder records a third log time for a second motion detection indication from a remaining motion detection zone of the first motion detection zone and the second motion detection zone of the camera that did not indicate first a motion event.

The method 700 in step 725 further includes detecting a presence of the train as the train enters an island with an island circuit. The event recorder records a fourth log time for activation of the island circuit. The method 700 in step 730 further includes calculating and recording a warning time as a difference between the first log time and the fourth log time with the event recorder.

The method 700 in step 735 finally includes logging a passing or a failing of the warning time inspection into the event recorder in a given route of the train travelling on the train track based on a motion detection in the first motion detection zone before or after the second motion detection zone and whether the warning time was more than or equal to a threshold time and whether the train travelled more than or equal to a threshold speed. The method 700 further includes determining with the event recorder whether the warning time was more than or equal to the threshold time and whether the train travelled more than or equal to the threshold speed and checking with the event recorder whether a motion event is detected in the first motion detection zone before or after the second motion detection zone.

Figure 8B:
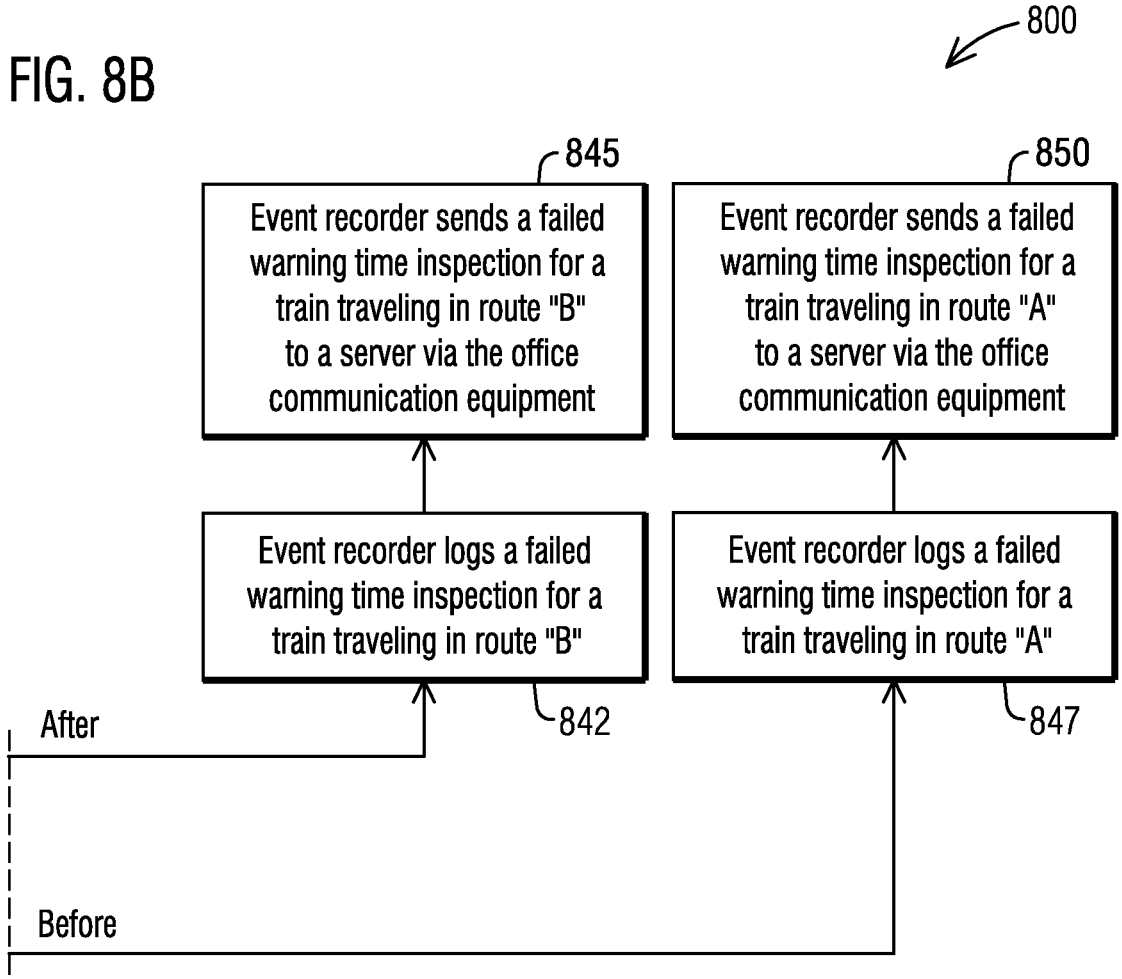
FIG. 8 illustrates a flow chart of a detailed method of automated warning time inspection for route detection of a single track using two motion zones is illustrated according to an exemplary embodiment of the present invention.

FIG. 8 illustrates a flow chart of a detailed method 800 of automated warning time inspection for direction detection of a single track using two motion zones is illustrated according to an exemplary embodiment of the present invention. Reference is made to the elements and features described in FIGS. 1-4. It should be appreciated that some steps are not required to be performed in any particular order, and that some steps are optional.

At step 802, the railroad crossing 25 is inactive and the train 30 enters the track circuit 12. The track circuit 12 activates. At step 805, the crossing warning system 15 activates. The event recorder 17 logs a time of activation of the crossing warning system 15. At step 807, the event recorder 17 logs a motion detection indication from a motion detection zone 1 or 2. At step 810, the event recorder 17 logs a motion detection indication from the remaining motion detection zone. At step 812, the train 30 enters an island and the island circuit 22 activates. The event recorder 17 logs a time of activation of the island circuit 22. At step 814, the event recorder 17 calculates and records a warning time as the difference between the crossing activation time and island circuit activation time.

At a decision block 820, a check is made as to the warning time being greater than or equal to a threshold time such as 20 seconds and as to the train travelling more than or equal to a threshold speed such as 50 mph. If YES, at a decision box 822, another check is made as to whether motion was detected in the motion detection zone 1 before or after the motion detection zone 2. If AFTER, at step 825, the event recorder 17 logs a passed warning time inspection for the train 30 traveling in a route "B". At step 827, the event recorder 17 sends a passed warning time inspection for the train 30 traveling in the route "B" to the server 75 via the office communication equipment 60. If BEFORE, at step 830, the event recorder 17 logs a passed warning time inspection for the train traveling in a route "A". At step 87, the event recorder 17 sends a passed warning time inspection for the train 30 traveling in the route "A" to the server 75 via the office communication equipment 60. If NEITHER, at step 835, the event recorder 17 logs a "test failed—motion detection system error" message. At step 837, the event recorder 17 sends a "test failed—motion detection system error" message to the server 75 via the office communication equipment 60.

If at the decision block 820, it is NO, at a decision box 840, another check is made as to whether motion was detected in the motion detection zone 1 before or after the motion detection zone 2. If NEITHER, the method 800 goes to the step 835 as set forth above. If AFTER, at step 842, the event recorder 17 logs a failed warning time inspection for the train 30 traveling in the route "B". At step 845, the event recorder 17 sends a failed warning time inspection for the train 30 traveling in the route "B" to the server 75 via the office communication equipment 60. If BEFORE, at step 847, the event recorder 17 logs a failed warning time inspection for the train traveling in the route "A". At step 850, the event recorder 17 sends a failed warning time inspection for the train 30 traveling in the route "A" to the server 75 via the office communication equipment 60.

At step 852, the train 30 exits the island circuit 22 and the island circuit 22 deactivates. At step 855, the train 30 exits the track circuit 12 and the track circuit 12 deactivates.

In one embodiment, the event recorder 17 will only log motion events while the track circuit 12 is active. Additionally, the event recorder 17 will only utilize the first motion indication from each zone, any duplicates will be ignored. This flow chart shows both motion zones setup prior to the island circuit 22. In one embodiment, they may effectively be setup at any two points along the track circuit 12 outside of the island circuit 22.

Figure 9:
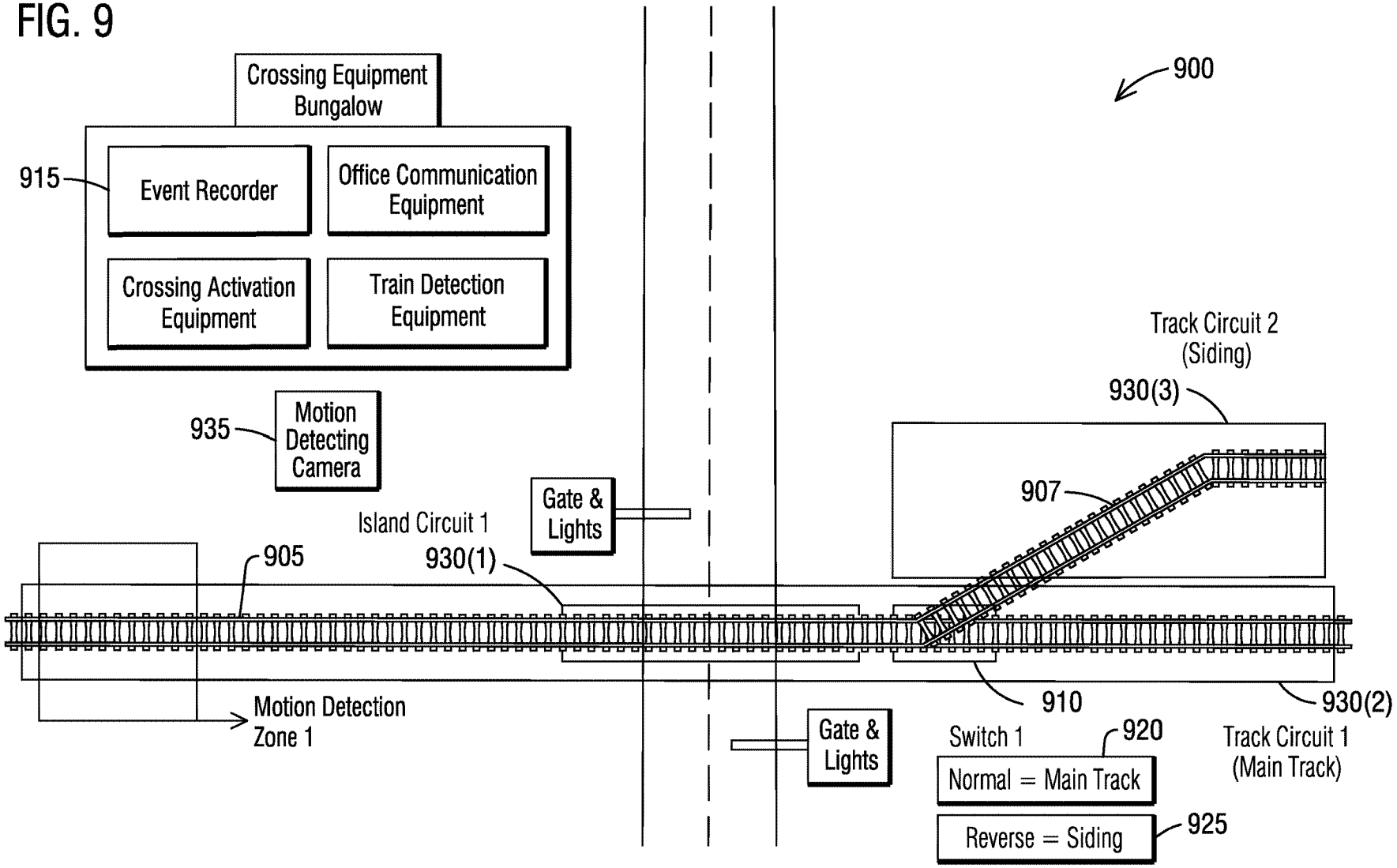
FIG. 9 illustrates a schematic block diagram of an automated warning time inspection system for route detection of a main track with switch to a siding track in accordance with an exemplary embodiment of the present invention.

FIG. 9 illustrates a schematic block diagram of an automated warning time inspection system 900 for route detection of a main track 905 with switch to a siding track 907 in accordance with an exemplary embodiment of the present invention. The automated warning time inspection system 900 shows how the automated warning time inspections will work when a track switch 910 is present. To summarize, an event recorder 915 receives switch indications as "normal" 920 or "reverse" 925 and uses that information along with track and island circuits 930(1-3) and a motion detecting camera 935 to determine a route that a train travelled in. FIG. 9 shows the most simple and likely most common switch configuration but as you can imagine these types of scenarios can become quite complex at installations with multiple tracks.

Figure 10B:
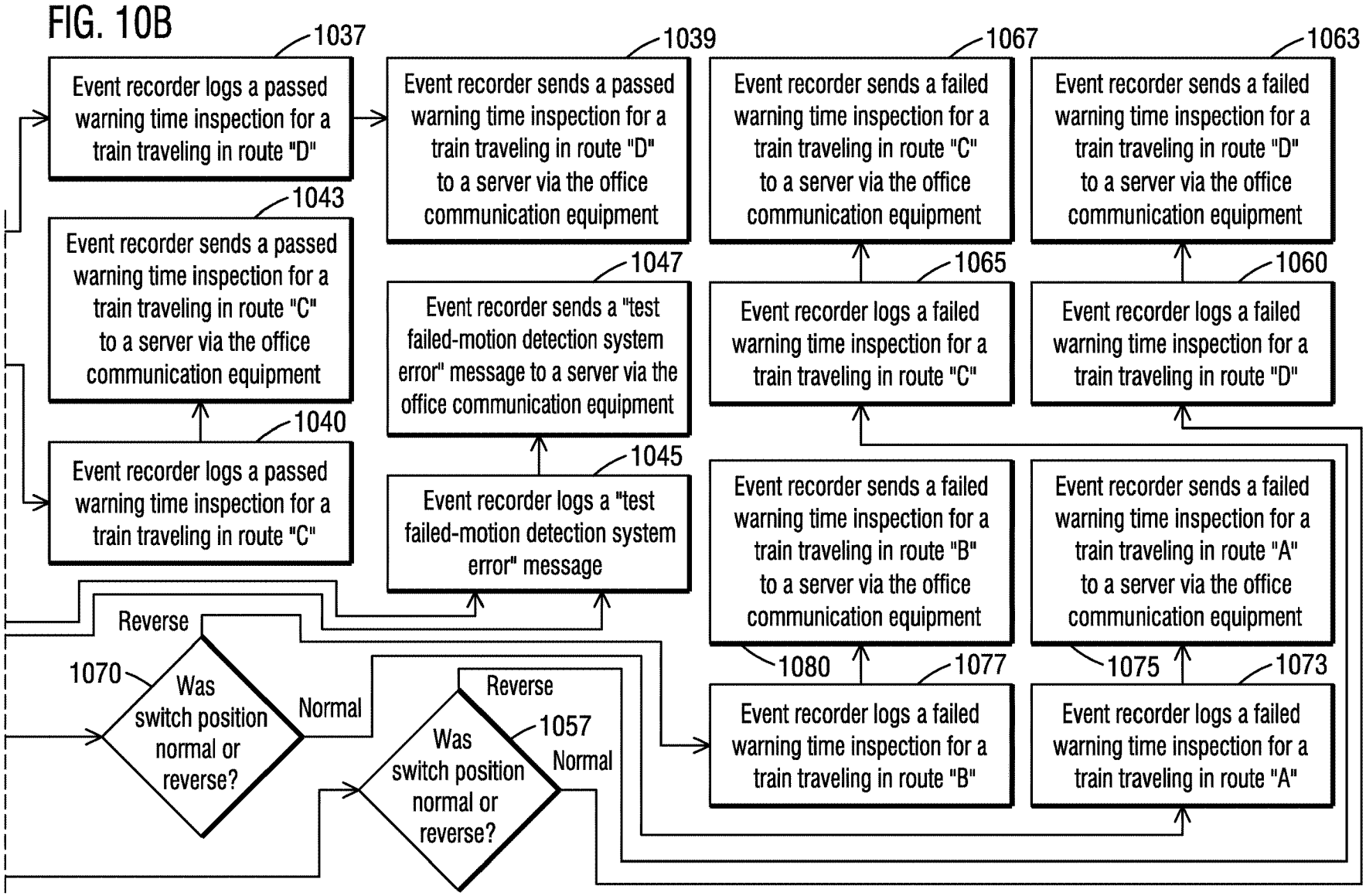
FIG. 10 illustrates a flow chart of a detailed method of automated warning time inspection for route detection of a main track with switch to a siding track is illustrated according to an exemplary embodiment of the present invention.

FIG. 10 illustrates a flow chart of a detailed method 1000 of automated warning time inspection for route detection of a main track with switch to a siding track is illustrated according to an exemplary embodiment of the present invention. In step 1003, the crossing is inactive and as a train enters the track circuit the track circuit activates.

In step 1005, a crossing warning system activates and the event recorder logs a time of activation and a switch position. In step 1007, the event recorder logs a motion detection indication if received. In step 1010, the train enters an island and an island circuit activates and the event recorder logs a time of activation. In step 1013, the event recorder calculates and records a warning time as the difference between the crossing activation time and the island circuit activation time. In step 1015, the train exits the island circuit and the island circuit deactivates. In step 1017, the event recorder logs a motion detection indication if received.

In a decision block 1020, a check is made as to was the warning time>=20 seconds and was the train speed>=threshold speed. If YES, in a decision block 1023, a check is made as to was a motion detected before or after the island. If AFTER, in a decision block 1025, a check is made as to was a switch position normal or reverse. If NORMAL, at step 1027, the event recorder logs a passed warning time inspection for a train traveling in route "A". At step 1029, the event recorder sends a passed warning time inspection for a train traveling in route "A" to a server via the office communication equipment. If REVERSE, at step 1030, the event recorder logs a passed warning time inspection for a train traveling in route "B". At step 1033, the event recorder sends a passed warning time inspection for a train traveling in route "B" to a server via the office communication equipment.

If BEFORE at the decision block 1023, in a decision block 1035, a check is made as to was the switch position normal or reverse. If NORMAL, at step 1037, the event recorder logs a passed warning time inspection for a train traveling in route "D". At step 1039, the event recorder sends a passed warning time inspection for a train traveling in route "D" to a server via the office communication equipment. If REVERSE, at step 1040, the event recorder logs a passed warning time inspection for a train traveling in route "C". At step 1043, the event recorder sends a passed warning time inspection for a train traveling in route "C" to a server via the office communication equipment.

If NEITHER at the decision block 1023, in a step 1045, the event recorder logs a "test failed—motion detection system error" message. At step 1047, the event recorder sends a "test failed—motion detection system error" message to a server via the office communication equipment.

If NO at the decision block 1020, in a decision block 1050, a check is made as to was a motion detected before or after the island activation. If NEITHER at the decision block 1050, in the step 1045, the event recorder logs a "test failed—motion detection system error" message. At the step 1047, the event recorder sends a "test failed—motion detection system error" message to a server via the office communication equipment.

If BEFORE at the decision block 1050, in a decision block 1057, a check is made as to was a switch position normal or reverse. If NORMAL, at step 1060, the event recorder logs a failed warning time inspection for a train traveling in route "D". At step 1063, the event recorder sends a failed warning time inspection for a train traveling in route "D" to a server via the office communication equipment. If REVERSE, at step 1065, the event recorder logs a failed warning time inspection for a train traveling in route "C". At step 1067, the event recorder sends a failed warning time inspection for a train traveling in route "C" to a server via the office communication equipment.

If AFTER at the decision block 1050, in a decision block 1070, a check is made as to was a switch position normal or reverse. If NORMAL, at step 1073, the event recorder logs a failed warning time inspection for a train traveling in route "A". At step 1075, the event recorder sends a failed warning time inspection for a train traveling in route "A" to a server via the office communication equipment. If REVERSE, at step 1077, the event recorder logs a failed warning time inspection for a train traveling in route "B". At step 1080, the event recorder sends a failed warning time inspection for a train traveling in route "B" to a server via the office communication equipment.

In step 1085, the train exits the track circuit and the track circuit deactivates. In one embodiment, the event recorder will only log motion events while the track circuit is active. Additionally, in one embodiment, the event recorder will only utilize the first motion indication from each zone, any duplicates will be ignored.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. An automated warning time inspection system (5) comprising:

a track circuit (12) disposed adjacent a railroad crossing (25) to detect presence of a train (30) on a train track (7), the track circuit (12) is configured to activate when the train (30) enters the track circuit (12);

a crossing warning system (15) configured to activate when the train (30) activates the track circuit (12);

an event recorder (17) configured to record a first log time 35(1) for activation of the crossing warning system (15);

a camera (20) to detect a first motion detection indication (40(1)) in a motion detection zone (10) of the camera (20) if there is any motion, wherein the event recorder (17) to record a second log time (35(2)) for the first motion detection indication (40(1)) if received; and an island circuit (22) to detect a presence of the train (30) as the train (30) enters an island (42), wherein the event recorder (17) to record a third log time (35(3)) for activation of the island circuit (22);

wherein the camera (20) is configured to detect a second motion detection indication (40(2)) in the motion detection zone (10) of the camera (20) after the activation of the island circuit (22) if there is any motion, wherein the event recorder (17) is configured to record a fourth log time (35(4)) for the second motion detection indication (40(2)) if received, wherein the event recorder (17) is configured to calculate and record a warning time (45) as a difference between the first log time (35(1)) and the third log time (35(3)) and based on a motion detection before or after the activation of the island circuit (22) and whether the warning time (45) was more than or equal to a threshold time (50) and whether the train (30) travelled more than or equal to a threshold speed (52) a passing or a failing of the warning time (45) inspection is logged into the event recorder (17) in a given route (55) of the train (30) travelling on the train track (7), wherein the event recorder (17) is configured to determine whether the warning time (45) was more than or equal to the threshold time (50) and whether the train (30) travelled more than or equal to the threshold speed (52) and then the event recorder (17) checks whether a motion event is detected before or after the activation of the island circuit (22), wherein if the warning time (45) was not more than or equal to the threshold time (50) or the train (30) travelled less than the threshold speed (52) and the event recorder (17) records the motion event before the activation of the island circuit (22) then the event recorder (17) logs a failed warning time inspection indication (67(1)) for the train (30) travelling in a first route (70(1)), and wherein if the warning time (45) was more than or equal to the threshold time (50) and the train (30) travelled more than or equal to the threshold speed (52) and the event recorder (17) records the motion event before the activation of the island circuit (22) then the event recorder (17) logs a passed warning time inspection indication (74(1)) for the train (30) travelling in the first route (70(1)).

2. The system (5) of claim 1, wherein if the warning time (45) was not more than or equal to the threshold time (50) or the train (30) travelled less than the threshold speed (52) and the event recorder (17) records the motion event after the activation of the island circuit (22) then the event recorder (17) logs a failed warning time inspection indication (67(2)) for the train (30) travelling in a second route (70(2)) different than the first route 70(1).

3. The system (5) of claim 2, wherein if the warning time (45) was not more than or equal to the threshold time (50) or the train (30) travelled less than the threshold speed (52) and the event recorder (17) records the motion event neither before nor after the activation of the island circuit (22) then the event recorder (17) logs a test failed-motion detection system error message (72(1)).

4. The system (5) of claim 3, wherein the event recorder (17) sends the test failed-motion detection system error message (72(1)) to a server (75) via office communication equipment (60).

5. The system (5) of claim 2, wherein the event recorder (17) sends the failed warning time inspection indication (67(2)) for the train (30) travelling in the second route (70(2)) to the server (75) via the office communication equipment (60).

6. The system (5) of claim 1, wherein the event recorder (17) sends the failed warning time inspection indication (67(1)) for the train (30) travelling in the first route (70(1)) to a server (75) via office communication equipment (60).

7. The system (5) of claim 1, wherein if the warning time (45) was more than or equal to the threshold time (50) and the event recorder (17) records the motion event after the activation of the island circuit (22) then the event recorder (17) logs a passed warning time inspection indication (74

(2)) for the train (30) travelling in a second route (70(2)) different than the first route (70(1)).

8. The system (5) of claim 7, wherein if the warning time (45) was more than or equal to the threshold time (50) and the train (30) travelled more than or equal to the threshold speed (52) and the event recorder (17) records the motion event neither before nor after the activation of the island circuit (22) then the event recorder (17) logs a test failed-motion detection system error message (72(1)).

9. The system (5) of claim 7, wherein the event recorder (17) sends the passed warning time inspection indication (74(1)) or the train (30) travelling in the first route (70(1)) to a server (75) via office communication equipment (60).

10. The system (5) of claim 7, wherein the event recorder (17) sends the passed warning time inspection indication (74(2)) for the train (30) travelling in the second route (70(2)) to a server (75) via office communication equipment (60).

11. An automated warning time inspection system (300) comprising:

a track circuit (312) disposed adjacent a railroad crossing (315) to detect presence of a train (317) on a train track (305), the track circuit (312) is configured to activate when the train (317) enters the track circuit (312);

a crossing warning system (320) configured to activate when the train (317) activates the track circuit (312);

an event recorder (322) configured to record a first log time (325(1)) for activation of the crossing warning system (320);

a camera (327) to detect a first motion detection indication (330(1)) in a first motion detection zone (310(1)) or a second motion detection zone (310(2)) of the camera (327), wherein the event recorder (322) is configured to record a second log time (325(2)) for the first motion detection indication (330(1)), wherein the event recorder (322) is configured to record a third log time (325(3)) for a second motion detection indication (330(2)) from a remaining motion detection zone of the first motion detection zone (310(1)) and the second motion detection zone (310(2)) of the camera (327) that did not indicate first a motion event;

an island circuit (332) to detect a presence of the train (317) as the train (317) enters an island, wherein the event recorder (322) is configured to record a fourth log time (325(4)) for activation of the island circuit (332); and wherein the event recorder (322) is configured to calculate and record a warning time (335) as a difference between the first log time (325(1)) and the fourth log time (325(4)) and based on a motion detection in the first motion detection zone (310(1)) before or after the second motion detection zone (310(2)) and whether the warning time (335) was more than or equal to a threshold time (350) and whether the train travelled more than or equal to a threshold speed (352) a passing or a failing of the warning time (335) inspection is logged into the event recorder (322) for a given route (345) of the train (317) travelling on the train track (305), wherein the event recorder (322) is configured to determine whether the warning time (335) was more than or equal to the threshold time (350) and whether the train travelled more than or equal to the threshold speed (352) and then the event recorder (322) checks whether a motion event is detected in the first motion detection zone (310(1)) before or after the second motion detection zone (310(2)), and wherein the first motion detection zone (310(1)) and the second motion detection zone (310(2)) are setup to determine a train direction (345), wherein depending upon which direction the train (317) is moving either the first motion detection zone (310(1)) or the second motion detection zone (310(2)) gets activated first such that once both the first motion detection zone (310(1)) or the second motion detection zone (310(2)) gets activated the train direction (345) is determined.

12. A method for an automated warning time inspection comprising:

detecting presence of a train (30) on a train track (7) with a track circuit (12) disposed adjacent a railroad crossing (25), wherein the track circuit (12) is configured to activate when the train (30) enters the track circuit (12);

activating a crossing warning system (15) when the train (30) activates the track circuit (12);

recording a first log time (35(1)) for activation of the crossing warning system (15) with an event recorder (17);

detecting a first motion detection indication (40(1)) in a motion detection zone (10) of a camera (20) if there is any motion, wherein the event recorder (17) to record a second log time 35(2) for the first motion detection indication (40(1)) if received;

detecting a presence of the train (30) as the train (30) enters an island (42) with an island circuit (22), wherein the event recorder (17) to record a third log time (35(3)) for activation of the island circuit (22);

detecting a second motion detection indication (40(2)) in the motion detection zone (10) of the camera (20) with the camera (20) after the activation of the island circuit (22) if there is any motion, wherein the event recorder (17) to record a fourth log time (35(4)) for the second motion detection indication (40(2)) if received;

calculating and recording a warning time (45) as a difference between the first log time (35(1)) and the third log time (35(3)) with the event recorder (17); and logging a passing or a failing of the warning time (45) inspection into the event recorder (17) in a given direction of the train (30) travelling on the train track (7) based on a motion detection before or after the activation of the island circuit (322) and whether the warning time (45) was more than or equal to a threshold time (50) and whether the train (30) travelled more than or equal to a threshold speed (52).

13. The method of claim 12, further comprising:

determining with the event recorder (17) whether the warning time (45) was more than or equal to the threshold time (50) and the train (30) travelled more than or equal to the threshold speed (52); and checking with the event recorder (17) whether a motion event is detected before or after the activation of the island circuit (22).

14. A method for an automated warning time inspection comprising:

detecting presence of a train (317) on a train track (305) with a track circuit (312) disposed adjacent a railroad crossing (315), wherein the track circuit (312) is configured to activate when the train (317) enters the track circuit (312);

activating a crossing warning system (320) when the train (317) activates the track circuit (312);

recording a first log time (325(1)) for activation of the crossing warning system (320) with an event recorder (322);

detecting a first motion detection indication (330(1)) in a first motion detection zone (310(1)) or a second motion detection zone (310(2)) of a camera (327), wherein the event recorder (322) to record a second log time (325(2)) for the first motion detection indication (330(1)), wherein the event recorder (322) to record a third log time (325(3)) for a second motion detection indication (330(2)) from a remaining motion detection zone of the first motion detection zone (310(1)) and the second motion detection zone (310(2)) of the camera (327) that did not indicate first a motion event;

detecting a presence of the train (317) as the train (317) enters an island with an island circuit (332), wherein the event recorder (322) to record a fourth log time (325(4)) for activation of the island circuit (322);

calculating and recording a warning time (335) as a difference between the first log time (325(1)) and the fourth log time (325(4)) with the event recorder (322); and logging a passing or a failing of the warning time (335) inspection into the event recorder (322) in a given direction (345) of the train (317) travelling on the train track (305) based on a motion detection in the first motion detection zone (310(1)) before or after the second motion detection zone (310(2)) and whether the warning time (335) was more than or equal to a threshold time (350) and whether the train (317) was travelling more than or equal to a threshold speed (352).

15. The method of claim 14, further comprising:

determining with the event recorder (322) whether the warning time (335) was more than or equal to the threshold time (350) and whether the train (317) travelled more than or equal to the threshold speed (352); and checking with the event recorder (322) whether a motion event is detected in the first motion detection zone (310(1)) before or after the second motion detection zone (310(2)).

16. A method for an automated warning time inspection comprising:

detecting presence of a train (30) on a train track (7) with a track circuit (12) disposed adjacent a railroad crossing (25), wherein the track circuit (12) is configured to activate when the train (30) enters the track circuit (12);

activating a crossing warning system (15) when the train (30) activates the track circuit (12);

recording a first log time (35(1)) for activation of the crossing warning system (15) with an event recorder (17);

detecting a first motion detection indication (40(1)) in a motion detection zone (10) of a camera (20) if there is any motion, wherein the event recorder (17) to record a second log time 35(2) for the first motion detection indication (40(1)) if received;

detecting a presence of the train (30) as the train (30) enters an island (42) with an island circuit (22), wherein the event recorder (17) to record a third log time (35(3)) for activation of the island circuit (22);

detecting a second motion detection indication (40(2)) in the motion detection zone (10) of the camera (20) with the camera (20) after the activation of the island circuit (22) if there is any motion, wherein the event recorder (17) to record a fourth log time (35(4)) for the second motion detection indication (40(2)) if received;

calculating and recording a warning time (45) as a difference between the first log time (35(1)) and the third log time (35(3)) with the event recorder (17);

logging a passing or a failing of the warning time (45) inspection into the event recorder (17) in a given direction of the train (30) travelling on the train track (7) based on a motion detection before or after the activation of the island circuit (322) and whether the warning time (45) was more than or equal to a threshold time (50) and whether the train (30) travelled more than or equal to a threshold speed (52); and determining with the event recorder (17) whether the warning time (45) was more than or equal to the threshold time (50) and the train (30) travelled more than or equal to the threshold speed (52).

17. A method for an automated warning time inspection comprising:

detecting presence of a train (317) on a train track (305) with a track circuit (312) disposed adjacent a railroad crossing (315), wherein the track circuit (312) is configured to activate when the train (317) enters the track circuit (312);

activating a crossing warning system (320) when the train (317) activates the track circuit (312);

recording a first log time (325(1)) for activation of the crossing warning system (320) with an event recorder (322);

detecting a first motion detection indication (330(1)) in a first motion detection zone (310(1)) or a second motion detection zone (310(2)) of a camera (327), wherein the event recorder (322) to record a second log time (325(2)) for the first motion detection indication (330(1)), wherein the event recorder (322) to record a third log time (325(3)) for a second motion detection indication (330(2)) from a remaining motion detection zone of the first motion detection zone (310(1)) and the second motion detection zone (310(2)) of the camera (327) that did not indicate first a motion event;

detecting a presence of the train (317) as the train (317) enters an island with an island circuit (332), wherein the event recorder (322) to record a fourth log time (325(4)) for activation of the island circuit (322);

calculating and recording a warning time (335) as a difference between the first log time (325(1)) and the fourth log time (325(4)) with the event recorder (322);

logging a passing or a failing of the warning time (335) inspection into the event recorder (322) in a given direction (345) of the train (317) travelling on the train track (305) based on a motion detection in the first motion detection zone (310(1)) before or after the second motion detection zone (310(2)) and whether the warning time (335) was more than or equal to a threshold time (350) and whether the train (317) was travelling more than or equal to a threshold speed (352); and determining with the event recorder (322) whether the warning time (335) was more than or equal to the threshold time (350) and whether the train (317) travelled more than or equal to the threshold speed (352).

* * * * *